US007766689B2

(12) United States Patent
Knoerrchen et al.

(10) Patent No.: US 7,766,689 B2
(45) Date of Patent: Aug. 3, 2010

(54) PLUG ADAPTER FOR AN ELECTRICAL SWITCHING DEVICE

(75) Inventors: Oliver Knoerrchen, Cologne (DE); Stephan Stanke, Rheinbach (DE)

(73) Assignee: Eaton Industries GmbH, Bonn (DE)

( * ) Notice: Subject to any disclaimer, the term of this patent is extended or adjusted under 35 U.S.C. 154(b) by 0 days.

(21) Appl. No.: 12/417,882

(22) Filed: Apr. 3, 2009

(65) Prior Publication Data

US 2009/0253306 A1 Oct. 8, 2009

(30) Foreign Application Priority Data

Apr. 4, 2008 (DE) ..... 10 2008 017 245

(51) Int. Cl.
*H01R 4/24* (2006.01)

(52) U.S. Cl. ..... 439/437

(58) Field of Classification Search ..... 439/441, 439/437, 438, 368, 651
See application file for complete search history.

(56) References Cited

U.S. PATENT DOCUMENTS

| | | | | |
|---|---|---|---|---|
| RE31,017 | E * | 8/1982 | Bernstein | 439/620.31 |
| 4,566,749 | A * | 1/1986 | Johnston | 439/441 |
| 4,759,726 | A * | 7/1988 | Naylor et al. | 439/441 |
| 5,061,203 | A * | 10/1991 | Allgood et al. | 439/441 |
| 5,626,488 | A * | 5/1997 | Albeck et al. | 439/395 |
| 5,876,237 | A * | 3/1999 | Patel et al. | 439/441 |
| 5,975,940 | A * | 11/1999 | Hartmann et al. | 439/441 |
| 6,261,120 | B1 * | 7/2001 | Beege et al. | 439/441 |
| 7,084,727 | B2 | 8/2006 | Bauer et al. | |
| 7,329,143 | B2 * | 2/2008 | Schrader | 439/441 |
| 2003/0076204 | A1 | 4/2003 | Whipple et al. | |
| 2004/0248457 | A1 * | 12/2004 | Walter | 439/441 |
| 2005/0270130 | A1 | 12/2005 | Roesner et al. | |
| 2007/0178747 | A1 * | 8/2007 | Schrader | 439/441 |

FOREIGN PATENT DOCUMENTS

| | | |
|---|---|---|
| DE | 4332068 | 3/1994 |
| DE | 19528410 | 2/1996 |
| DE | 19946568 | 4/2001 |
| DE | 10137497 | 5/2003 |
| DE | 10152347 | 6/2003 |
| DE | 10241198 | 8/2003 |
| DE | 10236790 | 10/2003 |
| DE | 102005023452 | 11/2006 |
| DE | 202006013824 | 10/2007 |
| EP | 0219570 | 4/1987 |
| EP | 0980124 | 2/2000 |

* cited by examiner

*Primary Examiner*—T C Patel
*Assistant Examiner*—Harshad C Patel
(74) *Attorney, Agent, or Firm*—Leydig, Voit & Mayer, Ltd.

(57) ABSTRACT

A plug adapter for plugging a connecting lead having at least two poles onto a switching device having a respective secondary contact, for a respective lead conductor, disposed parallel to a combination plug-in orifice includes, on a bottom side facing the switching device, a housing cutout. Associated with each of the at least two poles is a respective access contact including a contact spring. The access contact has a housing opening, and a respective plug, a respective conductor bar. The free end of the contact spring is elastically preloaded, and a clamping device is configured to simultaneously clamp the lead conductors to the contact spring and actuatable via an actuator bracket.

19 Claims, 2 Drawing Sheets

PLUG ADAPTER FOR AN ELECTRICAL SWITCHING DEVICE

CROSS-REFERENCE TO PRIOR APPLICATIONS

Priority is claimed to German Application No. 10 2008 017 245.6, filed on Apr. 4, 2008.

FIELD

The present invention generally relates to a plug adapter for an electrical switching device. In particular, the present invention relates to plug adapters for switching devices such as contactors, motor overload switches, electric cutouts or circuit breakers, or the like.

BACKGROUND

In conventional switching devices, such as contactors, for example, each pole to be switched has a terminal contact in the form of a fixed contact on the input side and on the output side. To make or break the contact, the corresponding fixed contacts are closed or opened by a contact bridge which is operated by a solenoid actuator. In such devices, the externally accessible fixed contact terminals are typically constituted of screw-type terminals which are accessible from the front side and can be screwed in place or released from the top side of the device. Releasable spring-loaded terminals, which are accessible laterally or from above and are also re-releasable from the side or from above, may also be provided. Incoming and outgoing connecting leads are contacted in different ways, plug-in contacts, floating contacts, screw terminals, insulation-piercing connecting devices or others being usable. To enhance the interconnection, respectively wiring capabilities of such switching devices, configurations have already been discussed which additionally provide for contacting by other external connecting leads (German Patent DE 102 36 790 C1). For this purpose, what are generally referred to as combination plug-in orifices and corresponding contact and connection means are configured on such switching devices.

The German Patent DE 10152347 C1 describes an adapter plug connector for a switching device on which leads are able to be contacted via a clamping device designed as incoming-feeder terminals. Individual conductors of the leads can be snapped into place in incoming-feeder terminals. Removing the individual conductors of the leads requires a tool for opening the incoming-feeder terminals.

Uncovering contact orifices and introducing and contacting connecting leads entail the disadvantage that either tools must be used and/or the user must perform a plurality of maneuvers, frequently even using both hands.

SUMMARY

It is an aspect of the present invention to provide a plug adapter for plugging in multiconductor connecting leads which allows flexible connecting leads, in particular, to be connected without tools and preferably in a readily manipulable manner.

In an embodiment, the present invention provides a plug adapter for plugging a connecting lead having at least two poles onto a switching device having at least two poles. The switching device has associated with each of the at least two poles a respective input-side terminal contact and a respective output-side terminal contact on an access side of the switching device, and a respective secondary contact configured for a lead conductor of the connecting lead. The secondary contact is disposed parallel to a combination plug-in orifice disposed on a top side of the switching device perpendicular to the access side, and is accessible to at least one of the respective input terminal contact and the respective output terminal contact. The plug adapter includes on a bottom side facing the switching device, a housing cutout having a breadth of the plug adapter, a width corresponding to a distance between the combination plug-in orifice and a top edge of the access side of the switching device, and a height extending from the top edge of the access side of the switching device to entry slots of the terminal contacts so as to provide access to the entry slots. Associated with each of the at least two poles is a respective access contact for the lead conductor of the connecting lead, the access contact being disposed in a clamping chamber and including a contact spring having a free end. The access contact has a housing opening parallel to an entry slot of the terminal contact, a respective plug contact configured to plug onto the secondary contact of the switching device, and a respective conductor bar disposed between the access contact and the plug contact. The free end of the contact spring is elastically preloaded against the conductor bar, and a clamping device is configured to simultaneously clamp the lead conductors to the contact spring and actuatable via an actuator bracket configured to act on a hold-down clamp so as to displace the free end of the contact spring away from the conductor bar.

BRIEF DESCRIPTION OF THE DRAWINGS

The present invention is illustrated in drawings which represent an exemplary embodiment. Specifically, the figures of the drawing show.

DETAILED DESCRIPTION

Figure 1:
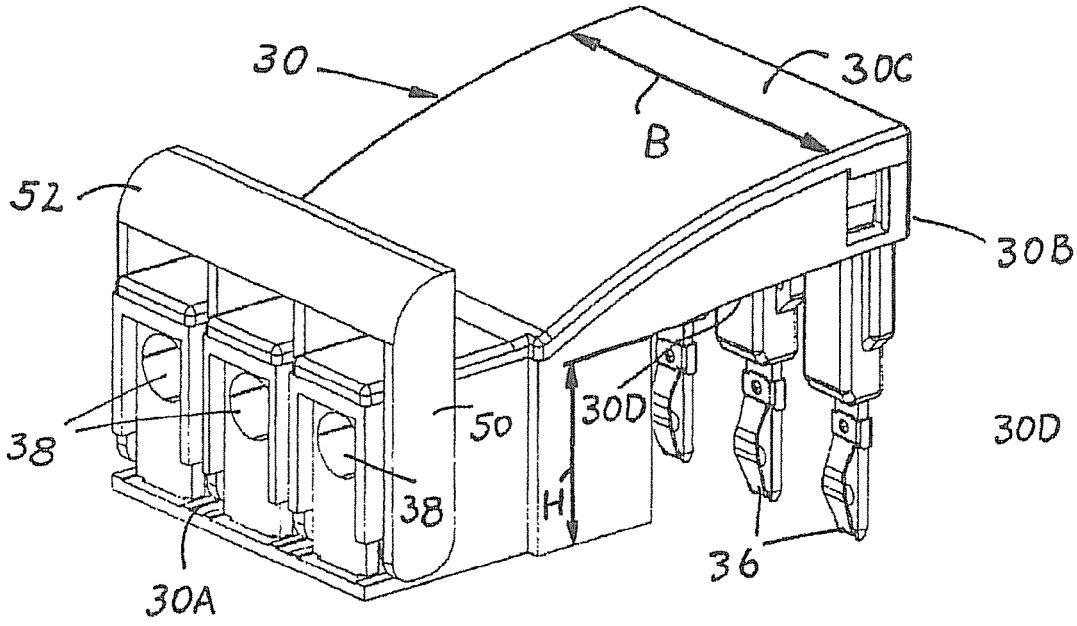
FIG. 1: a plug adapter according to an embodiment of the present invention.

The present invention is directed to a plug adapter for an electrical switching device, for each pole, the switching device having a terminal contact for an at least two-conductor lead. The lead terminal is recessed in a housing opening on one access side of the switching device. The lead terminal may be designed as a two-tier box terminal.

The access contact of the plug adapter is designed in the form of a contact spring which has one free end and is disposed in a clamping chamber. It is a question of a commercial push-in terminal. The access contact is accessible via an access-contact housing opening which—in the plugged-in position of the plug adapter—is disposed in parallel to the entry slot of the terminal contact of the switching device. The free contact spring end is placed under elastic preloading against the conductor bar. In addition, a clamping device for simultaneously clamping a plurality of lead conductors to the contact spring is provided in a configuration whereby the clamping device is (manually) actuable via an actuator bracket, the actuator bracket acting on a hold-down clamp, allowing the free contact spring arm to move away from the conductor bar of the plug adapter. In addition, on its bottom side facing the switching device, the plug adapter has a housing cutout whose dimensions are selected to match the top and front side of the switching device. Contact springs in push-in terminals have a relatively strong restoring or spring force. When the actuator bracket is used, its lever action is utilized so that manual actuation is possible using little expenditure of force.

The bottom side of the plug adapter is specifically designed to include a housing cutout to enable it be plugged with locking engagement onto a switching device. The housing cutout (in breadth, width, height dimensions) includes a snap-in locking dimension for snapping the plug adapter into place on the switching device. The housing cutout has the full breadth of the plug adapter that is determined by the number and dimensions of the connector blades, and has a span width which corresponds to the distance between the combination plug-in orifices of the switching device and the top edge of the switching-device access side, and a height which extends from the top edge of the switching-device access side to the entry slots of the terminal contacts, without covering the latter.

When the plug adapter is plugged onto the switching device, which is effected perpendicularly to the top side of the switching device, the plug-in contact(s) engages/engage into the combination plug-in orifice and the housing cutout over the top edge of the access side of the switching device. The seating of the plug-in contacts in the combination plug-in orifice may, in fact, provide the plug adapter with a certain hold, but the final fixed seating of the plug adapter is first effected by the 'mounting' of the housing cutout onto the top side of the switching device.

Flexible connecting leads may be connected without the use of screwdrivers, which would otherwise be required by other approaches, for example, to open two-tier terminals and to close the same following the introduction of the conductor ends. Simply by actuating the clamping device via the actuator bracket, the entry slot for the conductor end(s) or strand end(s) is able to be opened to the maximum dimensions. Differently precut strand ends may be used, in particular, those which are not crimped or tinned at the ends. Individual wires of strands have the tendency to spread apart. For that reason, a preferably large and easily accessible possible entry slot is devised.

Once the conductor or strand ends are introduced, the actuator bracket is relieved, thereby allowing the clamping device to attain the locking position in which the conductor ends are mutually clamped. The connecting lead is connected and reliably contacted.

An aspect of the present invention provides a rapid interchangeability of the basic components of a switching device, for example, in the case of motor starter combinations, because the outlay for wiring is reduced, and supplementary brackets on mounting or plug adapter rails, in particular as strain relief for leads, may be eliminated. The initial start-up may also be rapidly effected since few manipulation steps are required.

The lever arm of the actuator bracket is preferably be three to four times longer than that of the hold-down clamp when acting on the free contact spring arm.

The combination plug-in orifices are typically configured on the top side of the switching device so that the plug adapter is plugged perpendicularly onto the top side of the switching device.

The contact spring is designed as a spring-loaded metal band. It is preferably in the form of a band that is stretched out straight, whose one end is the free arm of the contact spring, and whose other end is fixed in the clamping chamber. The arms of the contact spring (two-armed design) are configured at an acute angle to one another. A contact spring arm projects as a free arm into the clamping chamber and is placed against the conductor bar. The other contact spring arm is fixed in position in the clamping chamber.

The plug-in contact is preferably designed as a connector blade and, thus, in shape and configuration, to mate fittingly into the combination plug-in orifice. The connector blade engages into the terminal contacts of the switching device in which an assigned plug-in orifice is configured.

The plug adapter is preferably designed as a multiphase (for example, three-phase) plug adapter, the electrical conductor elements being accommodated in a housing of insulating material as a monoblock.

In an embodiment of the present invention, connecting leads up to 4 $mm^2$, for example, may be plugged into the switching device and lockingly engaged thereto without the use of tools.

Figure 4:
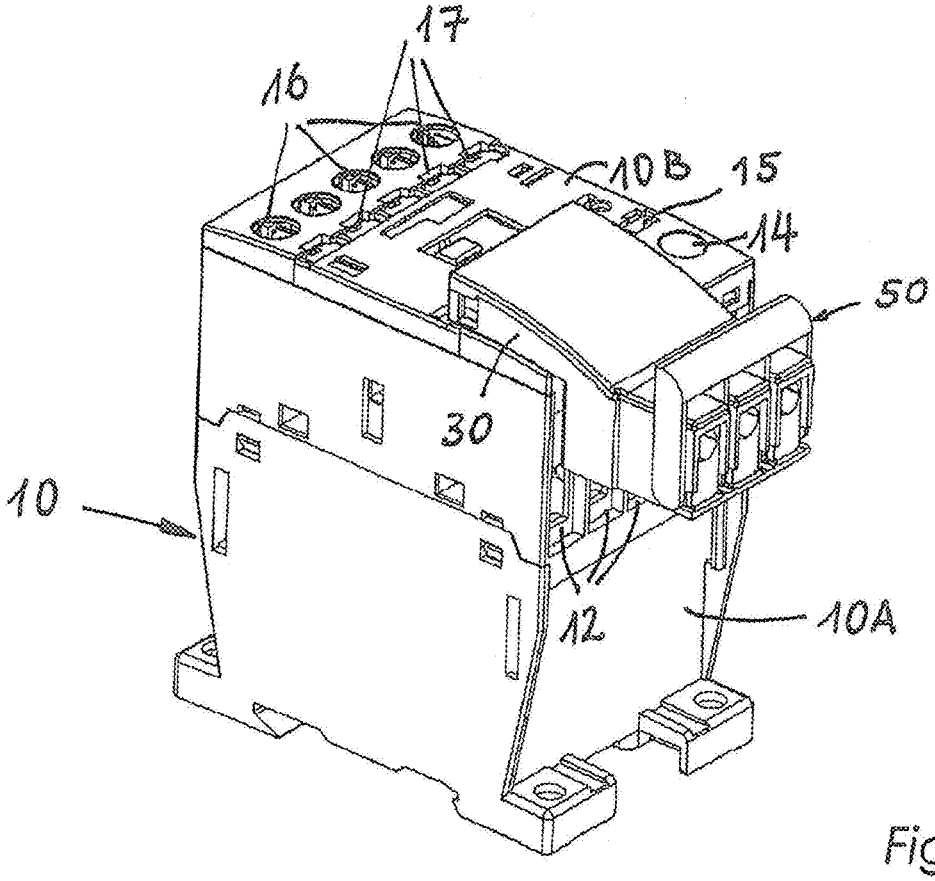
FIG. 4: the plug adapter in the plugged-in position on a switching device.

A three-phase plug adapter 30 according to an embodiment of the present invention is shown in a perspective view in FIG. 1. FIG. 4 shows the configuration of plug adapter 30 on a contactor 10. Plug adapter 30 is composed of a housing of insulating material having a front side 30A as a front or access side for a connecting or access lead (120). Front side 30A has three housing openings 38 for introducing and plugging in a connecting lead. Connector blades 36 are configured on rear side 30B perpendicularly to the plug-in direction of the connecting lead. Bottom side 30D of the plug adapter is specifically designed to include a housing cutout to enable it be plugged with locking engagement onto a switching device. Top side 30C of the plug adapter is designed to be true-to-form. The current path is formed in the housing of the plug adapter by corresponding current conductors 35.

Figure 2:
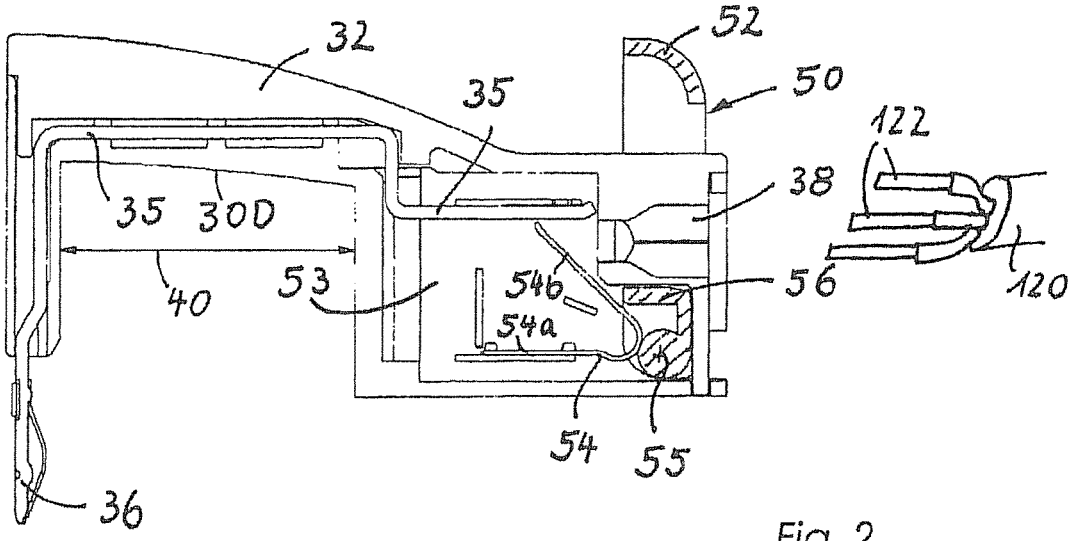
FIG. 2: a section through the plug adapter having a clamping device in the basic position.
Figure 3:
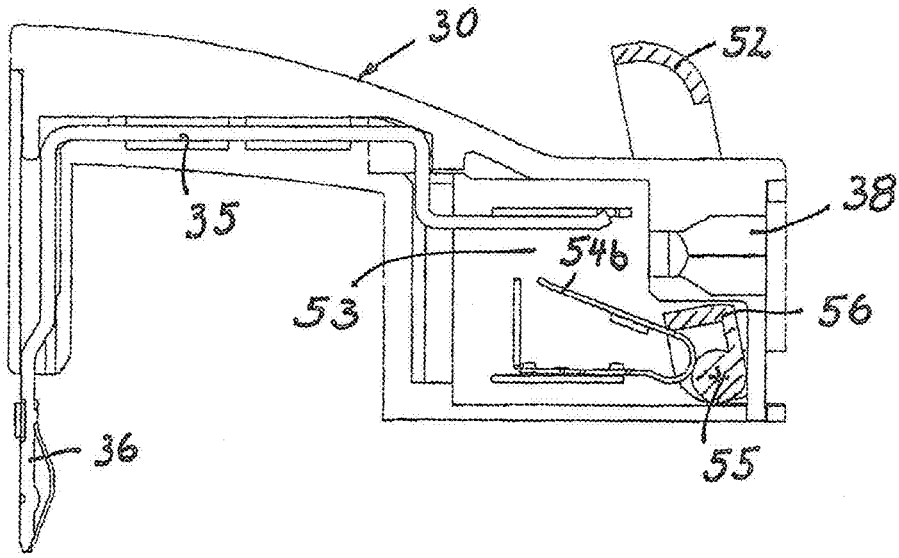
FIG. 3: a section through the plug adapter having an open clamping device.

FIGS. 2 and 3 show a section through the plug adapter, current conductors 35 and connector blades 36 being discernible. The length of the connector blades corresponds to the depth of combination plug-in orifices 15 in which the secondary contacts of the switching device, which are disposed in parallel to the terminal contacts of the switching device, are configured. Housing cutout 40, which is discernible (three-dimensionally with the dimensions breadth B, width 40, height H)—in cross section in the figures, constitutes a snap-in locking dimension for snapping the plug adapter into place on switching device 10. The housing cutout has full breadth B of plug adapter 30 that is determined by the number and dimensions of the connector blades. It has a span width 40 which corresponds to the distance between combination plug-in orifices 15 of switching device 10 and the top edge of switching-device access side 10A, and a height H which extends from the top edge of switching-device access side 10A to the entry slots of terminal contacts 12, without covering the latter. Housing cutout 40 provides for the positively engaged and immovable fitting of the plug adapter on the switching device.

In addition, FIG. 2 schematically shows the spatial assignment of a three-conductor (122) connecting lead 120 to the plug adapter.

Behind each of the already mentioned housing openings 38 is one clamping chamber 53 having a contact spring 54 which is fixed (54*a*) in the bottom region of the clamping chamber and is able to move elastically resiliently (free arm of contact spring 54*b*) in the upper region. When no connecting lead has been introduced, contact spring 54 is pressed in the upper region by the spring action against conductor 35. A clamping device 50, which is rotatably mounted (about a pivot point 55) in the bottom, front region of the clamping chamber, acts on the contact spring. The clamping device acts on all three contact springs in the clamping chambers simultaneously. The clamping device has a hold-down device 56 which may be used to move free arm 54*b* of the contact spring (in each clamping chamber). The clamping device is to be manually actuated by an operator, externally via an actuator bracket 52 that projects beyond the housing of plug adapter 30. The bracket on the clamping device is configured to come to rest perpendicularly to the plug adapter (in parallel to access side 30A) when the clamping device is in the clamping (arresting) position (FIG. 2). To actuate and open the access for a lead end 122 of a connection lead 120 (or to release the plugged-in lead ends), actuator bracket 52 is moved against the restoring force of free arm 54*b* of the contact spring toward rear side 30B, the contact spring freeing the space for introducing the connection lead (FIG. 3). Once the connection lead has been introduced, the bracket may be released, and free arm 54*b* of the contact spring presses the connection end (or all connection ends together) 122 from below against conductor bar 35.

Orifices 38 are selected to be relatively large, the orifices tapering conically toward the interior of clamping chamber 53. Therefore, this configuration allows strands 122, in particular, whose ends have not been compacted (for example, by crimping or by tinning at the ends) to be readily introduced, fixed in position and reliably contacted.

FIG. 4 shows plug adapter 30 in the plugged-in position on a switching device 10, in this case a multi-pole contactor. The housing of the switching device is composed of insulating material. At front or access side 10A, entry slots 12 leading to the terminal contacts (poles of the switching device) are discernible. These entry slots are not covered by the plug adapter.

A plurality of rows of orifices are discernible on top side 10B of switching device 10. Disposed in the front region (toward front side 10A of the switching device) is a first row of orifices 15 which are used for actuating the connecting means for the terminal contacts of the switching device. A clamping screw of a two-tier box terminal may be actuated by using a tool (screwdriver), for example. Disposed behind the first row of orifices 14 (in front) is the second row of combination plug-in orifices 15 which provide a parallel access to the terminal contacts. The combination plug-in orifices are utilized by the plug adapter according to the present invention. Connector blades 36 of the plug adapter are introduced into these orifices.

Discernible in the rear portion of the switching device (opposite the front side), in turn, are two rows of orifices 16, 17 whose function corresponds to that of orifices 14 and 15.

The present invention is not limited to the embodiments described herein; reference should be had to the appended claims.

LIST OF REFERENCE NUMERALS

10 switching device (contactor, motor overload switch)
10A front side of switching device; access side
10B top side of switching device
12 terminal contact (entry slot)
14 first row of access openings to terminal contacts
15 combination plug-in orifices in the second row
16 rear first row of orifices
17 rear second row of orifices
30 plug adapter
30A front side of plug adapter
30B rear side of plug adapter
30C top side of plug adapter
30D housing cutout
B breadth of the housing cutout
H height of the housing cutout
40 span width of the housing cutout
35 current conductor, conductor bar
36 plug-in contact (connector blade)
38 housing openings
50 clamping device
52 clamping bracket, actuator bracket
53 clamping chamber
54 contact spring
54*a*, 54*b* arms of the contact spring
55 pivot point
56 hold-down device
120 connection lead (control wire)
122 stand ends or conductor ends (lead conductors)

The invention claimed is:

1. A plug adapter for plugging a connecting lead having at least two poles onto a switching device having at least two poles, the switching device having associated with each of the at least two poles:

a respective input-side terminal contact and a respective output-side terminal contact on an access side of the switching device, and a respective secondary contact configured for a lead conductor of the connecting lead, the secondary contact being disposed parallel to a combination plug-in orifice disposed on a top side of the switching device perpendicular to the access side, and being accessible to at least one of the respective input terminal contact and the respective output terminal contact, the plug adapter comprising:

on a bottom side facing the switching device, a housing cutout having a breadth of the plug adapter, a width corresponding to a distance between the combination plug-in orifice and a top edge of the access side of the switching device, and a height extending from the top edge of the access side of the switching device to entry slots of the terminal contacts so as to provide access to the entry slots; and associated with each of the at least two poles:

a respective access contact for the lead conductor of the connecting lead, the access contact being disposed in a clamping chamber and including a contact spring having a free end, the access contact having a housing opening parallel to an entry slot of the terminal contact;

a respective plug contact configured to plug onto the secondary contact of the switching device;

a respective conductor bar disposed between the access contact and the plug contact, the free end of the contact spring being elastically preloaded against the conductor bar; and a clamping device configured to simultaneously clamp the lead conductors to the contact spring and actuatable via an actuator bracket configured to act on a hold-down clamp so as to displace the free end of the contact spring away from the conductor bar.

2. The plug adapter as recited in claim 1, wherein the actuator bracket includes a lever arm projecting beyond a housing of the plug adapter and being three to four times longer than a lever arm of the hold-down clamp.

3. The plug adapter as recited in claim 2, wherein the combination plug-in orifices are disposed on the top side of the switching device.

4. The plug adapter as recited in claim 2, wherein the contact spring includes a band.

5. The plug adapter as recited in claim 2, wherein the contact spring includes a first contact spring arm as a free arm projecting into the clamping chamber and disposed against the conductor bar and a second contact spring arm disposed in a fixed position in the clamping chamber.

6. The plug adapter as recited in claim 2, wherein the plug contact includes a connector blade.

7. The plug adapter as recited in claim 1, wherein the plug adapter includes three poles.

8. The plug adapter as recited in claim 2, wherein the plug adapter includes three poles.

9. The plug adapter as recited in claim 1, wherein the combination plug-in orifices are disposed on the top side of the switching device.

10. The plug adapter as recited in claim 9, wherein the contact spring includes a band.

11. The plug adapter as recited in claim 9, wherein the contact spring includes a first contact spring arm as a free arm projecting into the clamping chamber and disposed against the conductor bar and a second contact spring arm disposed in a fixed position in the clamping chamber.

12. The plug adapter as recited in claim 9, wherein the plug contact includes a connector blade.

13. The plug adapter as recited in claim 9, wherein the plug adapter includes three poles.

14. The plug adapter as recited in claim 1, wherein the contact spring includes a band.

15. The plug adapter as recited in claim 14, wherein the contact spring includes a first contact spring arm as a free arm projecting into the clamping chamber and disposed against the conductor bar and a second contact spring arm disposed in a fixed position in the clamping chamber.

16. The plug adapter as recited in claim 14, wherein the plug contact includes a connector blade.

17. The plug adapter as recited in claim 14, wherein the plug adapter includes three poles.

18. The plug adapter as recited in claim 1, wherein the contact spring includes a first contact spring arm as a free arm projecting into the clamping chamber and disposed against the conductor bar and a second contact spring arm disposed in a fixed position in the clamping chamber.

19. The plug adapter as recited in claim 1, wherein the plug contact includes a connector blade.

* * * * *